US009403055B2

(12) United States Patent
Alessandri et al.

(10) Patent No.: US 9,403,055 B2
(45) Date of Patent: Aug. 2, 2016

(54) EXERCISE DEVICE

(71) Applicant: TECHNOGYM S.P.A., Gambettola (FC) (IT)

(72) Inventors: Nerio Alessandri, Longiano (IT); Ivan Faedi, Savignano Sul Rubicone (IT); Claudio Cristofori, Faenza (IT)

(73) Assignee: TECHNOGYM S.P.A., Gambettola (FC) (IT)

( * ) Notice: Subject to any disclaimer, the term of this patent is extended or adjusted under 35 U.S.C. 154(b) by 146 days.

(21) Appl. No.: 14/074,928

(22) Filed: Nov. 8, 2013

(65) Prior Publication Data

US 2015/0133279 A1 May 14, 2015

(51) Int. Cl.

| | |
|---|---|
| ***A63B 23/02*** | (2006.01) |
| ***A63B 21/002*** | (2006.01) |
| ***A63B 22/18*** | (2006.01) |
| ***A63B 21/012*** | (2006.01) |
| ***A63B 26/00*** | (2006.01) |

(52) U.S. Cl.

CPC ..... *A63B 23/0205* (2013.01); *A63B 21/0023* (2013.01); *A63B 21/0125* (2013.01); *A63B 22/18* (2013.01); *A63B 23/0233* (2013.01); *A63B 26/003* (2013.01); *A63B 2208/0233* (2013.01); *A63B 2225/62* (2013.01)

(58) Field of Classification Search

CPC ..... A63B 41/00–41/10; A63B 43/04; A63B 23/0233; A63B 23/0205; A63B 47/00

USPC ..... 206/315.9–315.91; 150/158

See application file for complete search history.

(56) References Cited

U.S. PATENT DOCUMENTS

| | | | | |
|---|---|---|---|---|
| 1,927,492 | A * | 9/1933 | Halpin | 206/315.91 |
| 5,735,776 | A * | 4/1998 | Swezey et al. | 482/91 |
| 5,839,577 | A * | 11/1998 | Friedler | A45C 3/00 190/110 |
| 6,095,390 | A * | 8/2000 | Bogle | 224/664 |
| 6,712,745 | B1 * | 3/2004 | Lynne | 482/148 |
| 8,272,980 | B1 * | 9/2012 | Johnson | 473/603 |
| 2012/0329625 | A1 * | 12/2012 | MacColl et al. | 482/142 |

* cited by examiner

*Primary Examiner* — Oren Ginsberg
*Assistant Examiner* — Jennifer M Deichl
(74) *Attorney, Agent, or Firm* — Abelman, Frayne & Schwab

(57) ABSTRACT

Exercise device (1) comprising an exercise ball (10) and a cover (20) for housing and completely surrounding this ball (10); the cover being designed to couple, in use, in a substantially form-fitting manner to the outer surface of the shell (11) of the exercise ball (10) and being provided with a respective closing device (25) that can be selectively opened to allow the exercise ball (10) to be inserted into and extracted from the cover.

14 Claims, 3 Drawing Sheets

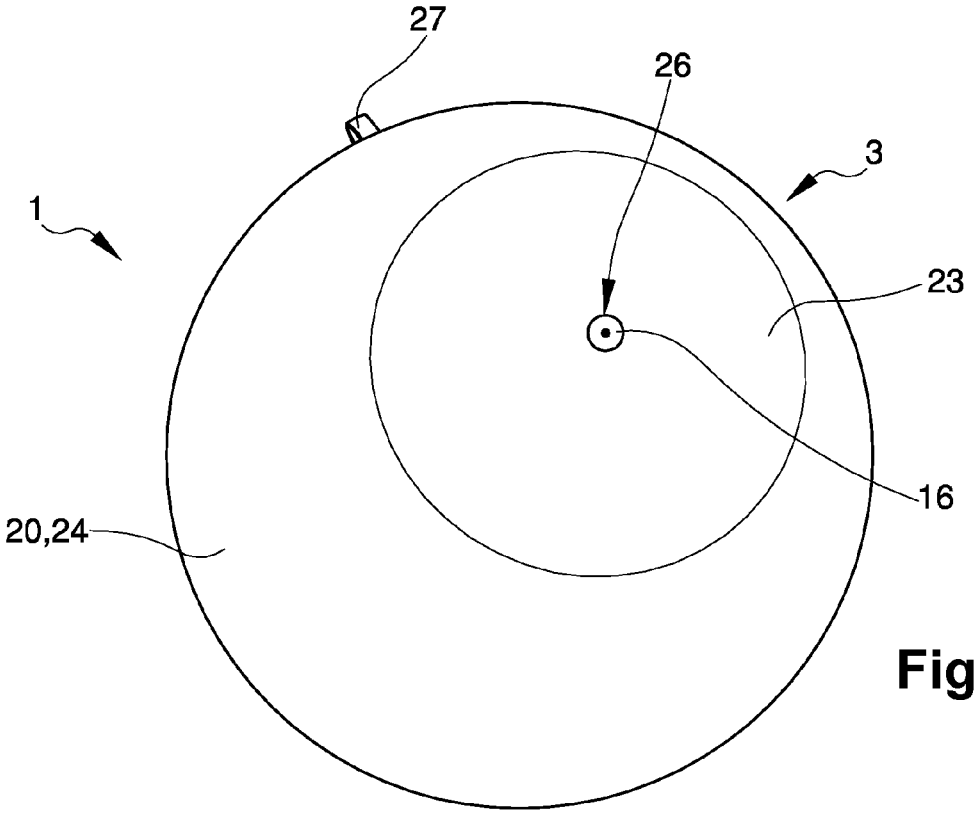
Fig. 3
Fig. 4
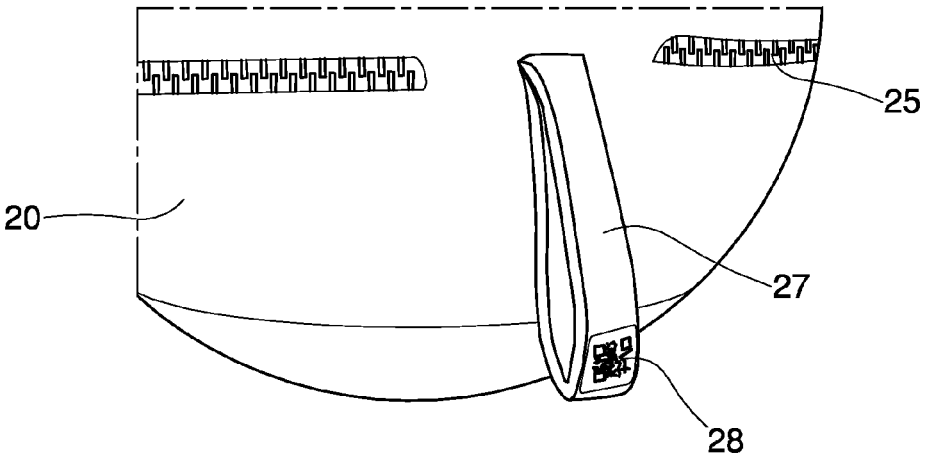

EXERCISE DEVICE

FIELD OF THE INVENTION

The present invention relates to an exercise device. More in particular, the present invention relates to an exercise device usable as a member for one person to sit on. In more detail, the present invention relates to an exercise device usable as a member for one person to sit on and execute gymnastic exercises to train dorsal, lumbar and abdominal muscles.

BACKGROUND TO THE INVENTION

In the field of fitness and indoor training, as well as postural training and remedial gymnastics, the use of the so-called fitness balls or stability balls is well known to perform physical exercises to train the dorsal, lumbar and abdominal muscles while being in constant unstable balance. These exercise devices are usually comprised of a ball that is made of an artificial and partially elastic material, for instance PVC, and maintains its shape through pressurized air at a given pressure.

A fitness ball is generally used as a support for a body portion of a user executing given gymnastic exercises and is designed to be deformed, in use, under the weight of this user so as to give a substantially unstable support. In this regard it should be noted that the lack of a stable support while executing gymnastic exercises forces the user's body to continuously attempt to find a balance position in a substantially dynamic manner by making small muscle movements to balance the local deformations of the fitness ball following even small movements of the user's arms. In this way, the execution of the traditional gymnastic exercises resting on a fitness ball allows to train a greater number of muscles and specifically allows to continuously involve the muscles that are generally less involved in executing these traditional exercises. The prolonged use of a fitness ball allows therefore to tone up the muscles that are generally not stressed while executing the traditional gymnastic exercises, such as press-up, pull-up, etcetera, and using isotonic gymnastic machines like chest press or leg extension, that are designed to separately train specific muscle regions.

For the reasons described above, the fitness balls are generally used to train the dorsal and lumbar muscles and to perform postural exercises for maintaining the backbone in a correct position. To this end, the use of fitness balls and stability balls as sitting members is well known also in environments not destined for training or remedial gymnastics, such as at home or office. For instance, the use of fitness balls as seats in an office is well known when the job requires to sit for the most part of the day, for instance in the case of people using a personal computer. In these cases, the use of a fitness ball may help in maintaining a correct posture of the backbone and allows to train the muscles without interfering with or interrupting the job at the workplace.

However, the use of the current fitness balls as sitting members has many drawbacks; therefore they have not yet spread at home or office. Firstly, the artificial material of the outer shell of the fitness ball tends to be polarised very easily, for instance through friction with the user's clothes or with a carpet, and therefore to capture and holds dust and dirt through electrostatic attraction. Furthermore, this material is not breathable and causes significant perspiration of the body portion resting on it for a prolonged time, for instance for entire work shifts. Lastly, it is not possible to avoid that, following a movement made by the user for his/her home or office activity, the lower portion of the fitness ball slides or rolls with respect to the floor, thus making the user fall with possible risk of injury.

In view of the above description the problem of having available a fitness ball or a stability ball that can be used for prolonged time as a sitting member is currently unsolved, and represents an interesting challenge for the applicant, aiming at producing an exercise device that can be deformed and used in absolute safety at home or office as sitting member, at least partially unstable.

In particular, it would be advisable to have available an exercise device that, in addition to present the consistency of, and to be deformed like, a common fitness ball, also presents characteristics of being anti-static, breathable in the contact areas with the user's body, and slip-resistant in the contact areas with the floor or other support surface.

In fact, an exercise device with these features would allow overcoming the drawbacks of the prior art and defining a new standard both in the field of exercise devices and in the field of sitting members usable at home and/or office.

SUMMARY OF THE INVENTION

The present invention relates to an exercise device. More in particular, the present invention relates to an exercise device usable as a member for one person to sit on. In more detail, the present invention relates to an exercise device usable as a member for one person to sit on and execute gymnastic exercises to train dorsal, lumbar and abdominal muscles.

The object of this invention is to provide a cover for an exercise device designed to make the surface of this latter antistatic, breathable and slip-resistant; this cover allows therefore to solve the above mentioned drawbacks and is therefore suitable to satisfy a plurality of requirements that to date have still not been addressed, and therefore suitable to represent a new and original source of economic interest.

According to the present invention a cover is provided for an exercise device, whose main characteristics will be described in at least one of the appended claims.

A further object of this invention is to provide an exercise device that can be also used effectively and safely at home and office as a member for one user to sit on.

According to the present invention an exercise device is provided, whose main characteristics will be described in at least one of the appended claims.

BRIEF DESCRIPTION OF DRAWINGS

Further characteristics and advantages of the cover and the exercise device according to the present invention will be more apparent from the description below, set forth with reference to the attached drawings, that illustrate some non-limiting examples of embodiment, where identical or corresponding parts are identified by the same reference numbers. In particular:

FIG. 3 shows a first enlarged detail extracted from FIG. 1;

FIG. 4 shows a second enlarged detail extracted from FIG. 1; and

DETAILED DESCRIPTION OF THE INVENTION

Figure 1:
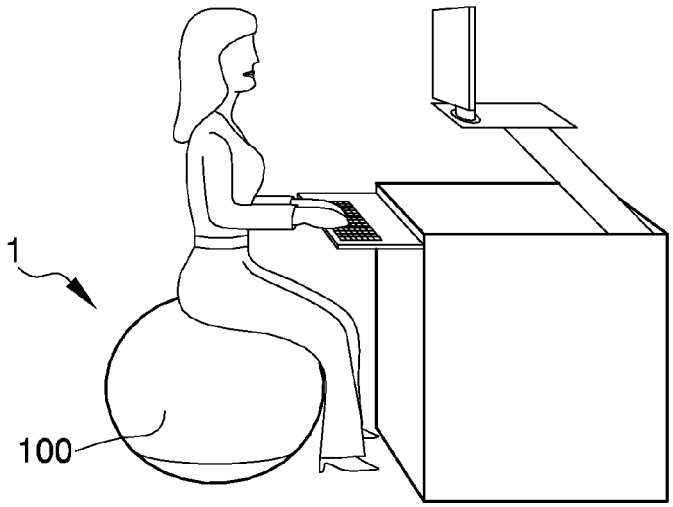
FIG. 1 is a schematic perspective view of an exercise device according to this invention.

In FIG. 1, number 1 indicates in its entirety an exercise device usable by a user as a sitting member 100 to facilitate a correct posture of the backbone while performing daily activities at home or office. In particular, with reference to FIGS. 2*a* and 2*b*, the exercise device 1 comprises inside itself an exercise ball 10 of the type usually called fitness or stability ball, whose outer shell 11 is mainly made of high resistant plastic, preferably, although without limitation, perforation-proof PVC. It should be specified that herein the term ball 10 will always indicate an exercise ball like a fitness or a stability ball, and therefore a ball which preferably presents a diameter comprised between 45 and 75 cm and can be easily deformed when compressed under the weight of the respective user. In use, this ball 10 is inflated with pressurized air at a given pressure, definable at will. To this end, the ball 10 presents a known back-pressure valve 16 for air inflation/deflation; as it will be clearly apparent below, this valve 16 is carried preferably, although without limitation, by the shell 1 in correspondence of the first lower portion 3 of the exercise device 1 which is, in use, into contact with the floor or with a respective support surface.

It should be noted that the exercise ball 10 does not present a uniform density; indeed, a polar portion thereof, indicated herein as second lower portion 13 of the shell 11, without however limiting the protective scope of this invention, preferably presents greater density, and therefore greater mass, with respect to the remaining part of the ball 10. In this way, when the ball 10, and therefore the exercise device 1, is made rotate or move in a given manner, even by chance, it always tends to return to a respective rest position, that is a position of stable balance wherein the second lower portion 13 faces the floor. To obtain this substantially asymmetrical density distribution of the ball 10, the shell 11 may preferably present different densities in different areas; it is possible for instance, although without limitation, to produce the second lower portion 13 using a PVC with a greater density than the PVC used to produce the remaining part of the shell 11. Alternatively, if you do not want to use two different types of PVC, it is possible to make the second lower portion 13 thicker than the remaining part of the shell 11, thus obtaining a uniform density distribution but a substantially asymmetrical mass distribution for the shell 11. As a further option to give the exercise ball 10 a substantially asymmetrical density distribution it is possible to couple (inside the shell 11 and in correspondence of the second lower portion 13) a layer of a further flexible material presenting high density and anyway greater density than the density of the PVC constituting the main component of the shell 11.

Figure 5:
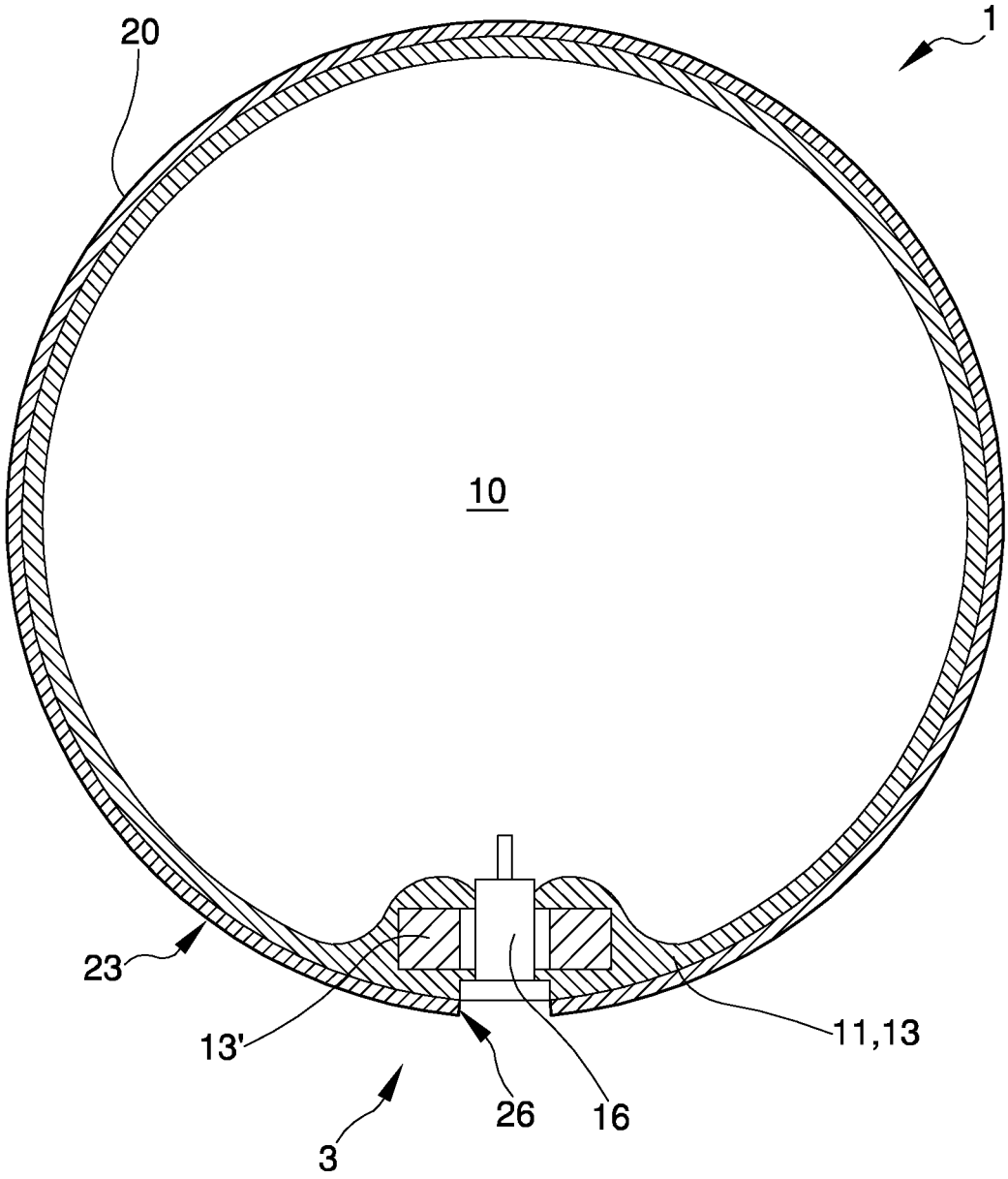
FIG. 5 shows a cross section of a variant of FIGS. 2A-B with a respective median plane.

Lastly, as a further option, instead of this layer of flexible material it is possible to use a preferably rigid body 13', with greater density than the density of the material forming the shell 11, for instance a metal annular body 13' surrounding the back-pressure valve 16 and coupled in a substantially integral manner with the second lower portion 13 of the shell 11. This annular body 13' may be for instance partially or completely embedded in the second lower portion 13 of the shell 11, as shown in FIG. 5 illustrating a possible variant of this invention.

In any case, independently of the construction, the ball 10, and therefore also the exercise device 1, presents a substantially asymmetrical mass distribution and, consequently, its centre of gravity is arranged along a radius in an intermediate portion between the centre of the ball 10 and the second portion 13. The nearer the centre of gravity to the second lower portion 13, the greater the stability of the rest position of the ball 10 and the greater the tendency of the exercise device 1 to return into this rest position following each respective rotation/displacement.

Figure 2A:
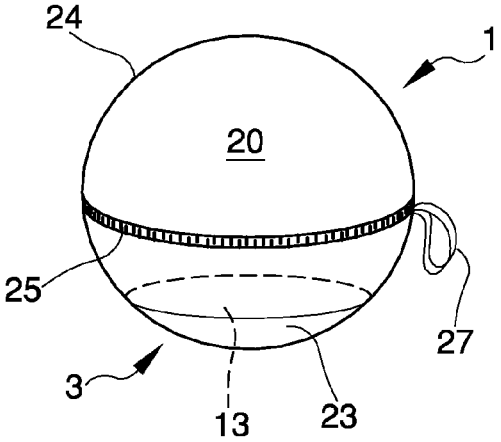
FIGS. 2A-B are schematic perspective views of an exercise device according to this invention illustrated in enlarged scale with respect to FIG. 1 and in two distinct configurations, respectively.
Figure 2B:
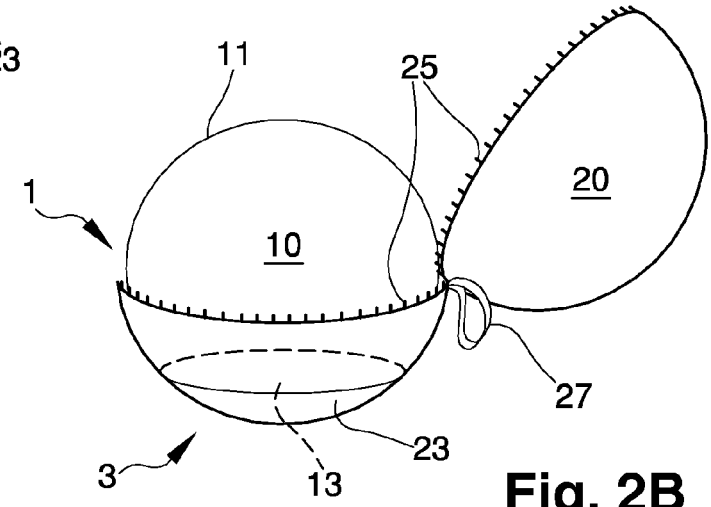

With particular reference to FIGS. 2*a* and 2*b* again, the exercise device 1 comprises a cover 20 which is preferably made of a textile material, houses the ball 10 and, in use, when the ball 10 is fully inflated, surrounds and couples to the outer surface of the shell 11 in a substantially form-fitting manner. With particular reference to FIG. 3, this cover 1 presents a third lower portion 23 preferably made of a given first slip-resistant material and arranged, in use, in correspondence of the second lower portion 13 of the shell 11 so that the set of the second and third lower portions 13 and 23 defines the first lower portion 3 of the exercise device 1. In view of what illustrated above as regards the density/mass distribution of the ball 10, this third lower portion 23 tends to remain, in use, into contact with the floor or the rest surface of the device 1 and, thanks to its slip-resistance, it prevents the exercise device 1 from rotating or displacing by chance, that could cause the user to fall and be injured. With particular reference to FIGS. 2A-B, the remaining portion of the cover 20, indicated as a whole with the reference number 24, is preferably made of a second given textile material, high breathable so as to make the contact between the exercise device 1 and the user's body portion comfortable even for a prolonged time, for instance during work shifts. Moreover, the second given material of the cover 20 presents preferably, although without limitation, antistatic features to prevent the exercise device 1 from collecting, in use, dust through electrostatic attraction.

With particular reference to FIGS. 2A-B again, the cover 20 presents a zip fastener 25 that preferably, although without limitation, subdivides this cover 20 into two equal symmetrical parts. In use, when the ball 10 is fully inflated and the exercise device 1 presents a substantially spherical shape, the zip 25 extends preferably along one of the maximum circles of the ball 10, thus subdividing the exercise device 1 into two hemispheres and allowing the ball 10 to be extracted from the cover 20 even if it is fully inflated. This maximum circle with which the zip 25 is associated is preferably the maximum horizontal circle that, for the sake of practicality, can be called "equatorial" circle when the exercise device 1 is in rest position. It should be noted that the use of the zip 25 allows the ball 10 to be extracted from/inserted into the cover 20 so as to allow, for instance, the cover 20 to be cleaned or the ball 10 to be replaced when damaged or holed. It should be also specified that the first and second given materials associated with the cover 20 present elastic features to couple to the shell 11 in a form-fitting manner, whereas the zip fastener 25 cannot be substantially extended and presents a substantially fixed longitudinal extension. Therefore, while inflating the ball 10, the zip 25 contrasts an excessive increase in the volume of the ball 10 and it can be therefore intended as a reference/indicating element showing the correct inflation level of the ball 10.

With particular reference to FIG. 3, it should be noted that the cover 20 presents a hole 26 that is aligned, in use, with the back-pressure valve 16 and is dimensioned to allow the ball 10 to be inflated/deflated without the need for being extracted from the cover 20. In view of the above description and with reference to FIG. 3, the hole 26 is therefore preferably provided in the third lower portion 23 of the cover 20 and presents a diameter comprised between 0.5 and 1 cm to allow a known inflation needle to be inserted in the back-pressure valve 16 of the ball 10.

With particular reference to FIG. 4, the cover 20 preferably presents a ring-shaped handle 27 extending from a portion of the maximum equatorial circle delimited laterally by the ends of the zip fastener 25. This handle allows a user both to transport the exercise device 1 easily and, in use, to put it again into position if it has been displaced by chance. In particular, the handle 27 allows a user, sitting onto the exercise device 1, to put it again into the desired position without the need for getting up and holding the exercise device 1 peripherally to move it.

Lastly, it should be noted that the cover 20 presents, preferably although without limitation, a recognition label 28 of the known type, for instance a bar code or a QR code. This label is preferably carried by the handle 27 and is designed to be recognised by a portable device, for instance a smart phone or a tablet, so as to allow the user of the device 1 to access a plurality of computerised services substantially in real time. For instance, through the recognition of the label 28 the user of the exercise device 1 can verify the origin and the features of this device and receive information and technical sheets and/or training instructions, also multimedia instructions, about the use of the device 1 as a sitting member.

The use of the exercise device 1 is clearly apparent from the description above and does not require further explanations. It is however useful to highlight some advantages resulting from the innovative features of this exercise device. In fact, thanks to the presence of the cover 20 provided with a respective slip-resistant lower portion, the exercise device 1 may be used in total safety, avoiding the user falling due to sudden and undesired displacements of the device 1. Furthermore, the presence of a breathable fabric in the upper portion of the cover 20 gives high comfort in using the device 1 and prevents an excessive perspiration of the user's body portion into contact with the device 1. Lastly, the opportunity of taking the cover off the exercise device 1 to wash the cover 20 ensures high hygiene in using the device 1.

Lastly, it is clearly apparent that variants and modifications can be done to the exercise device 1 and the respective cover 20 described and illustrated herein without however departing from the protective scope of the invention.

For instance, according to a not shown variant, the cover 20 may be constructed so that the third lower portion 23 presents a significantly greater density than the remaining portion 24, so that, in use, the cover 20 presents a substantially asymmetrical density distribution, and therefore mass distribution, similar to that described with reference to the exercise ball 10. Such a substantially asymmetrical mass distribution of the cover 20 may be obtained, for instance, by coupling to, or inserting into, the third lower portion 23 a metal cap or a closed bag containing fluid or semi-fluid high-density material. In any case, independently of the construction, it is clearly apparent that a substantially asymmetrical mass distribution of the cover 20 allows to obtain the advantages of the exercise device 1 described above also using the cover 20 in combination with a common fitness ball, for instance the exercise ball marketed by the Applicant under the name "wellness ball", whose membrane density is substantially homogeneous. Therefore, in view of the above description, the set of the cover 20 with substantially asymmetrical mass distribution and a respective fitness ball of the known type can be interpreted as an exercise device according to the present invention.

Lastly, it should be specified that the exercise device 1 of this invention provides a solution to the technical problem described above, i.e. it allows to have available an exercise device that can be used at home or office as a sitting member for a prolonged time absolutely safely and comfortably.

What is claimed is:

1. A cover designed to house, in use, a gymnastic ball (10) for a user to sit on, said cover comprising:

a spherically constructed housing comprising at least two portions attached together to define an accessible volume, said at least two portions configured to be attached together in a way that surrounds and couples to an outer surface of said gymnastic ball (10) in a substantially form-fitting manner;

a fastener for selectively attaching said at least two portions together, wherein said fastener can be selectively opened to allow said gymnastic ball (10) to be inserted into and extracted from said cover;

wherein said at least two portions comprise:

a lower portion (23) of said housing comprising a first given material with anti-slip properties configured to prevent, in use, said gymnastic ball (10) from sliding with respect to the floor while the user is seated; and an upper portion (24) of said housing comprising a second given material with breathable properties configured to contact a user's body for keeping the user comfortable.

2. A cover according to claim 1, wherein said fastener comprises a zip fastener (25).

3. A cover according to claim 2, wherein said fastener (25) extends, in use, along a circumference of said cover and forms an opening that extends for at least half of the circumference.

4. A cover according to claim 1, including a substantially asymmetrical mass distribution concentrated in said lower portion (23).

5. A cover according to claim 1, including a hole (26) than can be aligned, in use, with a back-pressure valve (16) of said gymnastic ball (10) and is dimensioned to allow said gymnastic ball (10) to be inflated and/or deflated.

6. A cover according to claim 1, wherein the fastener (25) is configured from a non-stretchable material to reach a predetermined maximum diameter upon inflating said gymnastic ball (10) wherein the maximum diameter cannot be substantially extended with further inflation thereby showing a bulging surface of said cover adjacent the fastener (25) if said gymnastic ball (10) has been over-inflated.

7. A cover according to claim 1, including at least one handle (27) to facilitate displacement of said gymnastic ball (10); said at least one handle (27) extending externally from a portion adjacent said fastener (25).

8. A cover according to claim 1, including an image recognition element (28).

9. A cover according to claim 8, wherein said recognition element (28) comprises an electronically recognizable label.

10. An exercise device for a user to sit on comprising:

a gymnastic ball (10);

a spherically constructed cover (20) comprising at least two portions attached together to define an accessible volume, said at least two portions configured to be attached together for housing and completely surrounding said ball (10); said cover being designed to substantially couple, in use, in a form-fitting manner to an outer surface of a shell (11) of said ball (10); and a fastener for selectively attaching said at least two portions together, wherein said fastener can be selectively opened to allow said ball (10) to be inserted into and extracted from said cover (20);

wherein said at least two portions comprise:

a portion (23) of said cover comprising a first given material with anti-slip properties configured to prevent, in use, said gymnastic ball (10) from sliding with respect to the floor while the user is seated; and an upper portion (24) of said cover comprising a second given material with breathable properties configured to contact a user's body for keeping the user comfortable.

11. A device according to claim 10, wherein said ball (10) includes a substantially asymmetrical mass distribution.

12. A device according to claim 11, wherein a lower portion (13) of said ball (10) includes a greater mass than the remaining part of said shell (11), so that, in use, the center of gravity of said ball (10) lies near said lower portion (13) of said ball.

13. A device according to claim 12, further comprising a body (13') with greater density than the density of the material forming said shell (11); said body (13') being housed inside said shell (11) and being coupled in a substantially integral manner with said lower portion (13) of said ball.

14. A device according to claim 13, wherein said body (13') comprises a metal body of substantially annular shape.

* * * * *